US011401931B2

(12) United States Patent
Trossmann et al.

(10) Patent No.: US 11,401,931 B2
(45) Date of Patent: Aug. 2, 2022

(54) SCREW PUMP WITH INTERSECTING BORES HAVING A LONGER FIRST AXIS OF SYMMETRY THAN A SECOND AXIS OF SYMMETRY

(71) Applicant: LEISTRITZ PUMPEN GMBH, Nuremberg (DE)

(72) Inventors: Oliver Trossmann, Oberasbach (DE); Roland Maurischat, Nuremberg (DE); Philipp Rossow, Rosstal (DE)

(73) Assignee: LEISTRITZ PUMPEN GMBH, Nuremberg (DE)

( * ) Notice: Subject to any disclaimer, the term of this patent is extended or adjusted under 35 U.S.C. 154(b) by 0 days.

(21) Appl. No.: 17/230,359

(22) Filed: Apr. 14, 2021

(65) Prior Publication Data

US 2021/0355938 A1 Nov. 18, 2021

(30) Foreign Application Priority Data

May 18, 2020 (DE) ..... 10 2020 113 372.3

(51) Int. Cl.
*F04C 2/16* (2006.01)

(52) U.S. Cl.
CPC ..... *F04C 2/16* (2013.01); *F04C 2230/10* (2013.01); *F04C 2230/602* (2013.01); *F04C 2240/30* (2013.01); *F04C 2250/30* (2013.01)

(58) Field of Classification Search
CPC ..... F04C 2/16–165; F04C 18/16–165; F04C 2250/30; F04C 2240/30; F01C 1/16–165
See application file for complete search history.

(56) References Cited

U.S. PATENT DOCUMENTS 4,963,079 A * 10/1990 Fujiwara ..... F01C 1/16 418/201.3
6,176,694 B1 * 1/2001 Fang ..... F04C 18/16 418/194
6,312,242 B1 * 11/2001 Fang ..... F04C 18/16 418/201.1
2010/0135837 A1 6/2010 Goepfert
2013/0301967 A1 * 11/2013 Schulz ..... F16C 35/06 384/456

(Continued)

FOREIGN PATENT DOCUMENTS

CA 2058325 A1 6/1992
DE 3546411 A1 7/1987

(Continued)

OTHER PUBLICATIONS

European Search Report, EP21168615 dated Jun. 3, 2021, 2 Pages.

(Continued)

*Primary Examiner* — Laert Dounis
(74) *Attorney, Agent, or Firm* — Lucas & Mercanti, LLP; Klaus P. Stoffel

(57) ABSTRACT

A screw pump, including a housing with a running bore having at least two intersecting bores, each of which receives a spindle, wherein the spindles have worm screw profiles which intermesh in portions and in operation bend in a defined bending direction under a hydraulic bending pressure, wherein each bore is configured as a slot with a longer first axis of symmetry and a shorter second axis of symmetry standing orthogonally thereto, wherein the longer first axis of symmetry runs in the bending direction.

15 Claims, 5 Drawing Sheets

(56) References Cited

U.S. PATENT DOCUMENTS

| | | | | |
|---|---|---|---|---|
| 2018/0087509 | A1* | 3/2018 | Johnson | F01C 21/02 |
| 2019/0078566 | A1 | 3/2019 | Inoue | |
| 2021/0164468 | A1 | 6/2021 | Deichmann | |

FOREIGN PATENT DOCUMENTS

| | | | |
|---|---|---|---|
| DE | 19625992 | C1 | 10/1997 |
| DE | 69129037 | T2 | 7/1998 |
| DE | 102011101648 | A1 | 11/2012 |
| DE | 102017210767 | A1 | 12/2018 |
| SU | 1435819 | A1 | 11/1988 |

OTHER PUBLICATIONS

German Patent Office issued an Office Action dated Apr. 15, 2021 regarding the parallel German Patent Application No. 102020113372.3, 8 pages.

Indian Patent Office issued an Examination Report dated Jan. 25, 2022 regarding the parallel Indian Patent Application No. 202114017352, 6 pages.

* cited by examiner

SCREW PUMP WITH INTERSECTING BORES HAVING A LONGER FIRST AXIS OF SYMMETRY THAN A SECOND AXIS OF SYMMETRY

CROSS-REFERENCE TO RELATED APPLICATIONS

The present application claims priority of DE 10 2020 113 372.3, filed May 18, 2020, the priority of this application is hereby claimed and this application is incorporated herein by reference.

BACKGROUND OF THE INVENTION

The invention concerns a screw pump comprising a housing with a running bore consisting of at least two intersecting bores, each of which receives a spindle, wherein the spindles have worm screw profiles which intermesh in portions and in operation bend in a defined bending direction under a hydraulic bending pressure.

Such screw pumps serve to convey widely varying fluid media. They comprise a housing with a running bore which is formed from at least two intersecting bores. Each of these bores receives a spindle, wherein usually one spindle is a drive spindle and the other is a running spindle driven via the other spindle. Sometimes two running spindles are provided which are arranged on either side of a central engagement spindle, wherein in this case the running bore consists of three intersecting bores. The spindles have corresponding worm screw profiles via which they intermesh, wherein the tooth engagement creates cavities which form the conveying chambers for the fluid to be conveyed. In this way, it is possible to convey the fluid supplied at one side from the suction side to the pressure side, where the fluid is delivered. The structure and function of such a screw pump is known in principle.

Screw pumps, as described, draw in the fluid to be conveyed on the suction side and convey it to the pressure side under constant compression. This leads to a corresponding pressure difference between the suction side and the pressure side, which, depending on design of the screw pump, may range from a few bar to well above 100 bar. This means that, in particular with a higher pressure difference, a corresponding hydraulic bending pressure is applied to the spindles since the fluid path is defined inside the pump and always oriented in a defined direction. This hydraulic bending pressure leads to a bending of the spindles in a defined bending direction, i.e. the spindles, which are usually mounted in plain bearings in the region of both spindle ends, undergo a slight deflection, i.e. are deformed. Since the spindles are arranged in the respective bores of the housing, which may either be an individual housing or an insert inserted in external housing, and rotate inside the corresponding bore, accordingly the position of the spindle relative to the bore wall changes, i.e. the width of the given ring-segment-like gap enlarges slightly on one side because of the bend, while it becomes slightly narrower on the other side, wherein viewed over the spindle length this width change naturally varies because of the bend geometry. To prevent the spindle or worm screw profile from coming into contact with the bore inner wall because of this bend, which would lead to great wear, the bore diameter is selected with a corresponding oversize so that, despite the bend, ideally a corresponding distance still remains even in the maximum bending region. In addition, it is known to arrange the spindles off-axis in the centric bore, i.e. with the spindle axis slightly offset from the center against the bending direction. This design is fashioned such that, in the region of maximum bend, the distance of the spindle from the bore wall is approximately the same both in and against the bending direction. This results in a gap with almost constant gap width between the spindle and the bore inner wall in this region. The size of the gap surrounding all spindles, which is shaped approximately as a figure-of-eight in the case of a running bore consisting of two bores, is a factor in the calculation of the delivery quantity. This is because there is a degree of leakage through this gap, i.e. a certain quantity of fluid which is not conveyed. The greater the gap or the peripheral gap cross-section, the greater the leakage proportion.

SUMMARY OF THE INVENTION

The invention is thus based on the problem of indicating a screw pump which is improved in this respect.

To achieve this object in a screw pump of the type cited initially, it is provided according to the invention that each bore is configured as a slot with a longer first axis of symmetry and a shorter second axis of symmetry standing orthogonally thereto, wherein the longer first axis of symmetry runs in the bending direction.

The screw pump according to the invention accordingly does not have centric i.e. circular bores, as is usual in the prior art, but slot-like bores, i.e. bores which do not have a unique radius but which are defined by two different axes of symmetry standing orthogonally to one another. The slot-like bore has a first longer axis of symmetry and a second shorter axis of symmetry standing orthogonally thereto. The longer axis of symmetry runs in the bending direction, while the shorter axis of symmetry runs orthogonally thereto. This embodiment has the advantage that, firstly, a flexion of the spindles is still possible since, as the flexion takes place along the axis of symmetry, there is sufficient space within the bore to ensure that the spindle or its worm screw profile does not run against the bore inner wall. In the direction orthogonally thereto, however, in which no deformation takes place, because of the slot-like design it is possible to reduce the distance between the opposing wall faces of the bore so that, overall, the gap width is smaller in the direction of the second axis of symmetry than in the direction of the first axis of symmetry. Because of this slot-like bore geometry, therefore, the total gap cross-sectional area can be significantly reduced, since, because of the slot-like design with a longer and a shorter axis of symmetry, the gap surrounding the respective spindle is not round with a constant width over the periphery but has a width which varies around the periphery. Depending on how close the opposing bore inner wall regions come to the spindle in the shorter axis of symmetry, there is a correspondingly great reduction in gap width, which in turn is reflected in a correspondingly large reduction in the overall gap cross-section.

This reduction of gap cross-section thus necessarily leads to a significant reduction in the leakage volume over the differential pressure range, wherein tests have shown that a reduction of up to 25% or more is easily possible.

Thus the screw pump according to the invention, or the bore geometry provided according to the invention, firstly allows problem-free and low-wear pump operation, since spindle bending resulting from the hydraulic bending pressure is possible without problems and always a sufficient distance remains from the adjacent bore walls in the direction of the long axis of symmetry, and at the same time, because of the reduced gap diameter in the direction of the shorter axis of symmetry, a significant reduction in overall gap cross-section and hence leakage volume is achieved. This results firstly in extremely low-wear operation, and secondly a significantly more efficient conveying operation in comparison with the previous circular bore geometry.

To allow the distance of the spindle or worm screw profile in the direction of the first longer axis of symmetry to be approximately the same on both sides in the direction of the first longer axis of symmetry, it is suitable to arrange the spindles or their spindle axes in unloaded state offset from the center of the first axis of symmetry, i.e. position these quasi-eccentrically. As stated, the location of the equal distance finally concerns the region of the greatest spindle flexion, wherein this region usually lies in the mid-spindle region.

The arrangement is suitably such that the spindles are positioned so that, for a defined pressure difference between a suction side and a pressure side of the pump or within a defined differential pressure range, the width of the gap between the worm screw profiles and the bore inner wall in the direction of the first axis of symmetry is greater than the width of the gap in the direction of the second axis of symmetry. This means that the arrangement of spindles is such that, in the case of bending, the distance of the worm screw profile from the bore inner wall in the direction of the first axis of symmetry in both axial directions is always greater than the distance or gap width in the orthogonal second axis of symmetry. Accordingly, in operation, the gap is always narrower in the direction of the second axis of symmetry than in the direction of the first axis of symmetry. Finally, in this bending region, symmetrical conditions can thus be achieved in the direction of both axes of symmetry.

As described, each bore is designed as a slot-like bore with two axes of symmetry of different length standing orthogonally to one another. Such a bore may be formed for example using a milling tool which allows not only the creation of a cylindrical bore but its slight extension in the direction of the first axis of symmetry into a slot-like form. Furthermore, there is an alternative possibility of extending the bore by grinding a cylindrical bore in the manner of a slot. Firstly, a single cylindrical bore is made which is then ground in defined fashion to form the longer axis of symmetry. A further alternative possibility of forming the bore, in contrast, is to form each bore from two separate intersecting single bores, the bore axes of which are offset from one another in the bending direction. Each bore accordingly consists of two intersecting single bores. These are offset minimally to one another in the bending direction, i.e. their bore axes are minimally spaced in the bending direction, namely by the distance of the expected maximum flexion which lies for example in the range from 0.1 to 0.3 mm. Forming the bore from two separate single bores firstly has the advantage that the bore as such is easy to create, since forming the bores requires only a simple linear movement of the boring tool. In addition, a boring tool may be used which has a smaller diameter than a boring tool used to produce a circular centric bore, as is usually the case in the prior art (the same applies equally to the use of a milling cutter, wherein this too may be selected with a smaller diameter). It must merely be ensured that the diameter of the two single bores is sufficiently large for the spindle, viewed in the direction of the second axis of symmetry, to still be adequately spaced from the bore wall albeit via a significantly narrower gap, since there is still sufficient space in the direction of the first axis of symmetry to receive the bend. When forming two intersecting single bores, in the intersection region i.e. in the direction of the second axis of symmetry, because of the geometry, there remains a minimal web or shoulder extending inward into the bore by only a few microns because of the only minimal offset of the bore axes. This indeed marginally narrows the gap, but its height is sufficiently small that it does not have a disadvantageous effect on the spindle movement in and against the bending direction, especially since no spindle deformation occurs in the direction of the second axis of symmetry.

The two single bores suitably extend over the entire length of the housing, which simplifies their production. The housing as described may be a complete housing or a central housing block which is closed merely by two covers. Alternatively, the housing may be an insert which is inserted in a corresponding external housing.

As an alternative to the design in which the two single bores of each bore extend over the entire housing length, according to a variant of the invention, it is also possible that each bore consists of two bore portions adjoining one another axially, wherein the central axes of the bore portions are angled relative to one another. With this embodiment of the invention, accordingly each bore is composed of two separate bore portions, wherein each bore portion itself is formed from two separate single bores as described above. The bore portions naturally transform into one another, but are not arranged axially or are not aligned axially with one another but are marginally angled relative to one another. The angle is selected such that this approximately follows the bending geometry of the spindle. This means that each bore portion, which begins at a housing side and runs towards the housing center, runs minimally obliquely, so that viewed in cross-section a minimal V-shape results, wherein the tip of the V points in the bending direction. This bore geometry therefore receives the spindle bending geometry, so that the bore geometry is better adapted to the actual conditions and in particular the bend-adapted gap resulting from the slot-like form better follows the spindle bend when viewed in the axial direction.

Preferably, the screw pump is a double-flow pump, i.e. each spindle has two axially adjacent worm screw profiles with equal and opposite pitch, which are preferably arranged approximately in the region of the longitudinal center of the respective spindles or approximately symmetrically to the longitudinal center. In this double-flow pump form, corresponding worm screw profiles are provided which run in opposite directions and extend from the region of the spindle center in the direction of the spindle ends where the spindle is mounted. Alternatively, however, it may be a single-flow pump in which each spindle has only one worm screw profile rising in one direction.

The screw pump itself may be a pure fluid pump. Alternatively, however, it may also be a multiphase pump which can convey not only a pure fluid but also a fluid-gas mixture.

As well as the screw pump itself, the invention furthermore concerns a housing for a screw pump of the type described above. The housing has a running bore consisting of at least two intersecting bores, each of which receives a spindle, wherein the spindles have worm screw profiles which intermesh in portions and in operation of the screw pump bend in a defined bending direction under a hydraulic bending pressure. This housing, which may be the actual pump housing or an insert in an external pump housing, according to the invention is distinguished in that each bore is configured as a slot with a longer first axis of symmetry and a shorter second axis of symmetry standing orthogonally thereto, wherein the longer first axis of symmetry runs in the bending direction.

Here, preferably, each bore is formed from two separate intersecting single bores, the bore axes of which are offset from one another in the bending direction. Alternatively, the slot-like bore may also be designed as a milled bore, i.e. the milling tool is guided accordingly to extend the bore, forming the longer axis of symmetry. As a further alternative, the slot-like bore may also be ground from a cylindrical bore, i.e. locally material is removed in targeted fashion by grinding to form the longer axis of symmetry.

Each of the two single bores may extend over the entire length of the housing, i.e. the whole bore consists of these two axially running single bores. Alternatively, it is conceivable that each bore consists of two bore portions adjoining one another axially, wherein the central axes of the bore portions and hence the central axes of the single bores of a bore portion are angled relative to those of the other bore portion. Here, therefore, each bore portion is formed from two separate single bores, the bore axes of which are angled slightly relative to one another, i.e. assume an angle not equal to 180° to one another and are not aligned with one another. This allows the entire bore geometry to be tilted minimally to follow the bending line.

The invention furthermore concerns a method for producing a housing for a screw pump of the type described initially, comprising a running bore formed from at least two intersecting bores. This method is distinguished in that to form each bore, either at least two separate, intersecting single bores, the bore axes of which are offset from one another, are bored in a housing body. The two single bores or their bore axes are offset from one another in a predefined bending direction.

Furthermore, it may be provided that the single bores extend over the entire length of the housing body. Alternatively, each bore may consist of two axially adjacent bore portions, wherein the central axes of each bore portion are angled relative to one another, wherein to form the bore portions, two separate single bores are bored on the two mutually opposing sides of the housing body. The bore portions or single bores meet in the housing center, which is the region of maximum spindle bend.

The various features of novelty which characterize the invention are pointed out with particularity in the claims annexed to and forming a part of the disclosure. For a better understanding of the invention, its operating advantages, specific objects attained by its use, reference should be had to the drawings and descriptive matter in which there are illustrated and described preferred embodiments of the invention.

DETAILED DESCRIPTION OF THE INVENTION

Figure 1:
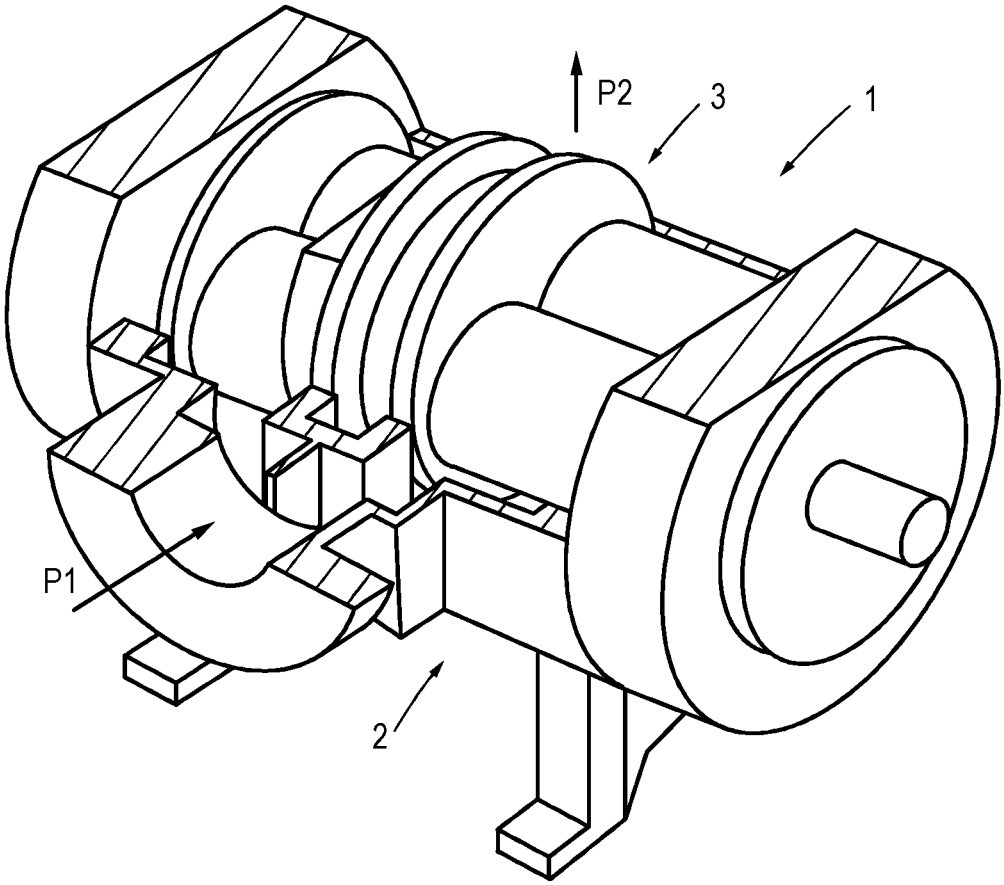
FIG. 1 a perspective view of a screw pump according to the invention in partially cut-open state, FIG. 2 the cut-open inner housing with two spindles of the screw pump from FIG. 1, FIG. 3 an end view of a housing from FIG. 2 showing the running bore, FIG. 4 a general illustration of the formation of the two bores forming the running bore, each of which consists of two intersecting single bores, FIG. 5 a general illustration of a slot-like bore and spindle arranged off-axis thereto in unloaded state, FIG. 6 the arrangement from FIG. 5 with loaded spindle, FIG. 7 a general illustration of a centric bore with spindle arranged off-axis according to the prior art, FIG. 8 the arrangement from FIG. 7 with loaded spindle, and FIG. 9 a general illustration of a screw pump or housing with two bore portions arranged at an angle to one another.
Figure 2:
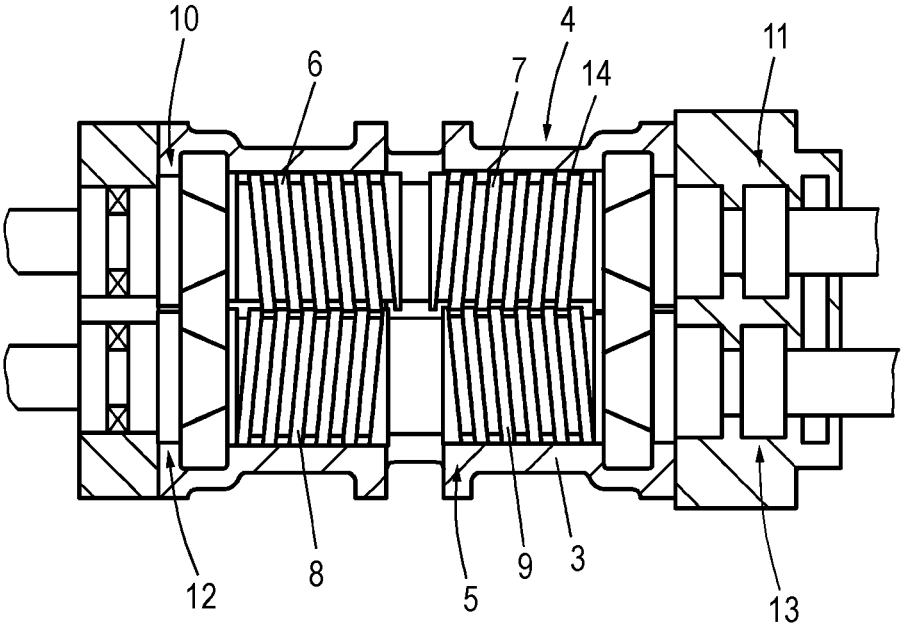

FIG. 1 shows, in a partially cut-open perspective view, a double-flow screw pump 1 according to the invention comprising an external housing 2 with an inner housing 3 formed as an insert, in which two spindles 4, 5 (see FIG. 2) are arranged which serve to draw in, convey and deliver a fluid or a fluid-gas mixture. For this, on the housing side, an inlet is provided as depicted by arrow P1, via which the fluid is drawn in. The fluid is delivered under pressure via an outlet (not shown in detail) arranged at 90° in the example shown, as depicted by the arrow P2.

The two spindles 4, 5 each have two worm screw profiles 6, 7 and 8, 9 respectively, wherein the worm screw profile pairs 6, 7 and 8, 9 have mutually opposing pitches. This means that the screw pump 1 is a double-flow screw pump. In the known fashion, the worm screw profiles 6 and 8 intermesh, as do the worm screw profiles 7 and 9.

The two screw spindles 4, 5 are supported and rotationally mounted at their ends via a corresponding bearing means 10, 11 or 12, 13, wherein the bearing means 10-13 are usually plain bearings.

Figure 3:
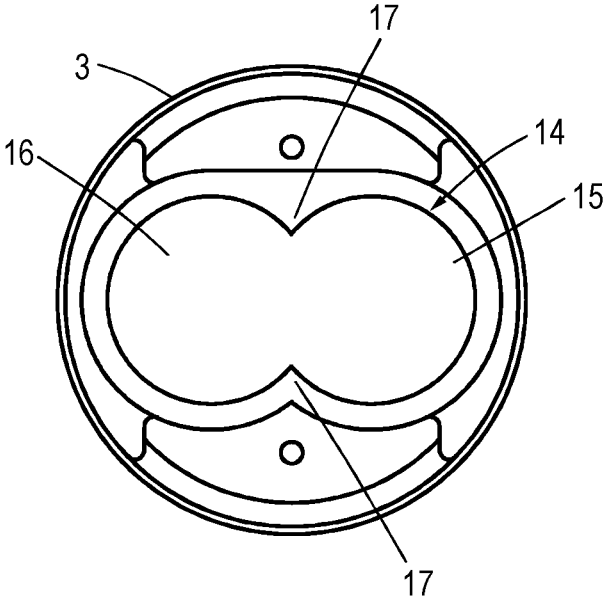

The two spindles 4, 5 are received in a running bore 14 which has the form of a "horizontal figure-of-eight" and is shown as a general depiction in FIG. 3. FIG. 3 shows an end view of the housing 3 looking onto the running bore 14, which extends axially straight through the housing 3.

The running bore 14 consists of two separate bores 15, 16 which intersect, forming two central shoulders 17. A spindle 4, 5 is received in each bore 15, 16 and rotates therein, wherein one spindle is the drive spindle coupled to a drive motor while the other spindle is the running spindle. In the example shown, as an example, spindle 5 is the drive spindle while spindle 4 is the trailing running spindle. The spindles 4, 5 are received in the running bore 14 or in the bores 15, 16, spaced from the adjacent bore inner wall so that they can rotate without contact. Accordingly, a gap is formed surrounding the two spindles 4, 5, which also has the form of a horizontal figure-of-eight.

According to the invention, each of the bores 15, 16 is configured as a slot, i.e. each bore 15, 16 is not a circular bore but has a longer and a shorter axis of symmetry. Naturally, the two bores 15, 16 intersect, but a defined, specific slot geometry is assigned to each bore.

Figure 4:
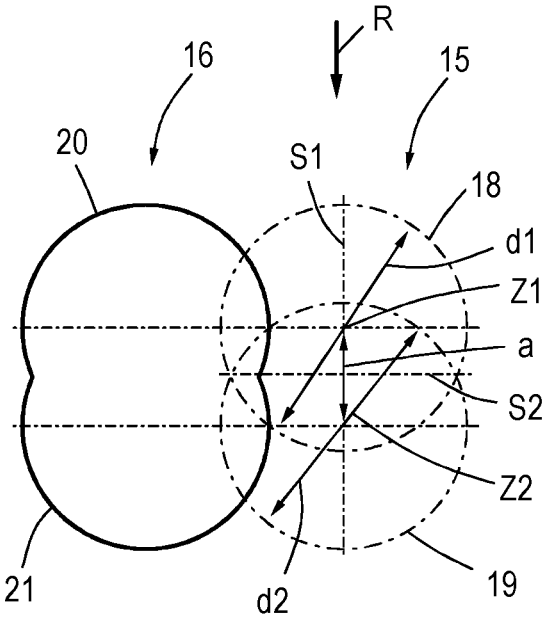

FIG. 4 shows a general illustration of this. The two bores 15, 16 are shown. Each bore 15, 16 consists of two intersecting single bores 18, 19 in the case of the bore 15, and 20, 21 in the case of the bore 16. The two single bore pairs 18, 19 and 20, 21 have respective bore or central axes Z1 and Z2, which are here spaced apart from one another in a bending direction R. This bending direction R is the direction in which the respective spindle 4, 5 bends under the hydraulic bending pressure which is present in the housing 3 and results from the pressure difference between the suction side and the pressure side. This bend is admittedly minimal but still present, and results from the spindles 4, 5 being effectively supported at the ends via the bearing means 10-13. This defined bend deformation in the bending direction R now leads to the worm screw profiles 6, 7, 8, 9 slightly changing their position relative to the bore inner wall, compared with the unloaded state, so that—as will be described below—the width of the corresponding gap surrounding the respective spindle 4, 5 or the respective worm screw profile 6-9 varies.

In FIG. 4, purely for reasons of clarity, the respective single bores 18, 19 or 20, 21 are shown considerably spaced apart from one another by distance a between their central axes Z1. In fact, the distance a amounts for example to just 0.1-0.3 mm, i.e. is minimal but measurable.

This offset of the single bores 18, 19 in the bending direction R now leads to the resulting bore 15, 16 having a slot-like geometry, i.e. no longer having a circular bore form or inner wall form but a slightly elongated bore form. Each single bore 15, 16 therefore has a longer first axis of symmetry S1 which extends in the bending direction R, and a second shorter axis of symmetry S2 orthogonally thereto. The axes of symmetry S1, S2 for the bore 15 are shown, while the geometry of the bore 16 is identical. The length difference between the axes of symmetry S1 and S2 finally corresponds to the distance a between the two central axes Z1, Z2, i.e. is also approximately 0.1-0.3 mm.

As described, FIG. 4 is a purely general illustration with respective single bores 18, 19 or 20, 21 which are spaced exaggeratedly far apart from one another. As a result, in FIG. 4, a shoulder exists on the right-hand side of the bore 15 and on the left-hand side of the bore 16. This is however only marginally pronounced for the given minimal axial offset a, i.e. has a height of a few microns, and accordingly does not hinder the spindle movement or bend and also has no influence on the pump operation.

Figure 5:
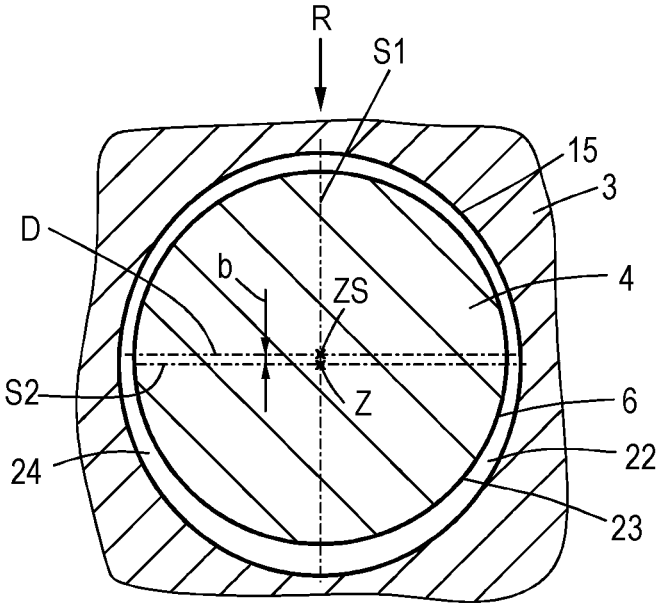
Figure 6:
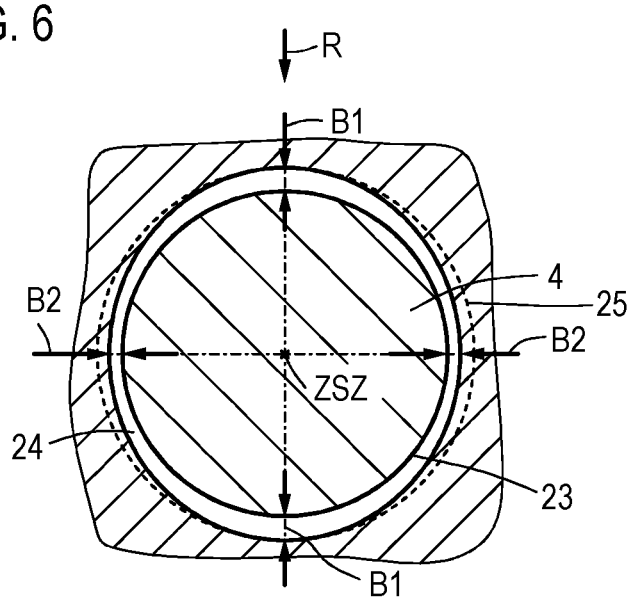
Figure 7:
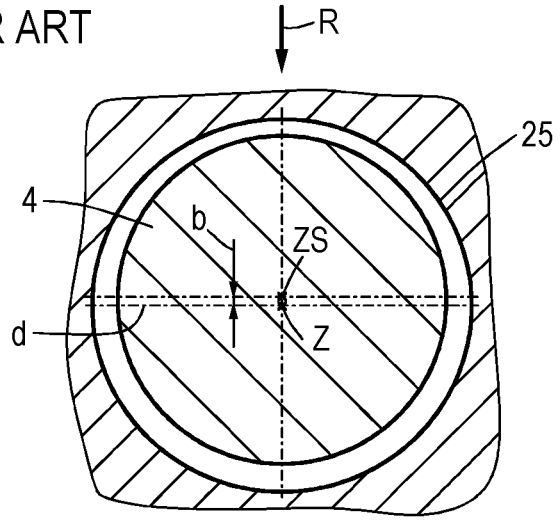
FIG. 7 PRIOR ART
Figure 8:
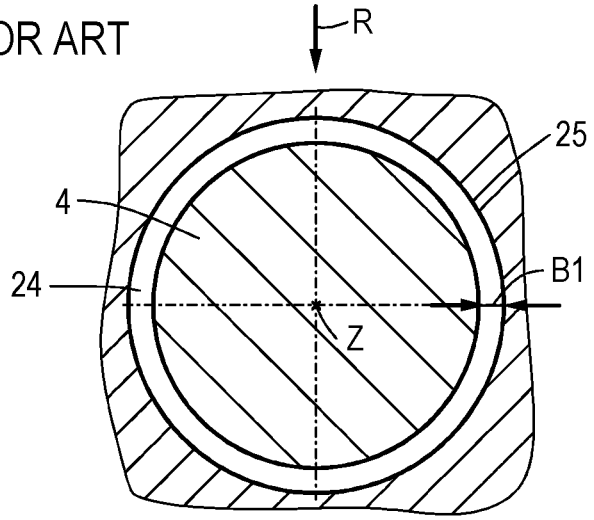
FIG. 8 PRIOR ART

The function of this slot-like design of the bores 15, 16 in comparison with a purely centric bore (previously usual in the prior art) becomes clear when FIGS. 5 and 6 are compared with FIGS. 7 and 8. FIG. 5 in the form of a general illustration shows a slot-like bore 15 which is here shown closed for reasons of description and illustration (the following description presenting the fundamental principle naturally applies equally to the second slot-like bore 16, which supplements the bore 15 to form the running bore 14 of figure-of-eight shape). Furthermore, as a general illustration, the spindle 4 and the outer periphery of the worm screw profile 6 are shown. As FIG. 5 shows, between the inner wall 22 of the slot-like bore 15 and the outer periphery 23 of the worm screw profile 6, a peripheral gap 24 is formed which is annular in the example shown and in which the fluid to be conveyed collects during operation (in the running bore, the gap to be assigned to the respective bore 15, 16 has only a ring-segment shape, wherein the two ring segments supplement one another into the figure-of-eight form). Furthermore, the longer first axis of symmetry S1 and the shorter second axis of symmetry S2 are shown. The drawing also shows the diameter D of the spindle 4 and its longitudinal or central axis ZS. This is evidently spaced from the longitudinal center or central axis Z of the bore 15 by a distance b, against the bending direction R. This means that, as shown in FIG. 5, it is offset slightly upward from the middle of the bore 15. Distance b finally corresponds to distance a by which the two single bores 18, 19 forming the bore 15 are offset.

If now, in operation, a hydraulic bending pressure acts on the spindle 4 in the direction of the bending direction R, this bends slightly. FIG. 6 shows this operating situation, wherein here the region of maximum spindle bend is shown. Evidently, the central axis ZS of the spindle 4 and the central axis Z of the bore 15 coincide in this example. The spindle 4 thus bends slightly down in the bore 15. This means that the width B1 of the here annular gap or space 24, viewed in the direction of the first longer axis of symmetry S1 and hence in the bending direction R, is almost the same as in the unloaded state. Viewed in the direction of the second shorter axis of symmetry S2, however, the width B2 of the gap 24 is significantly narrower. The gap width changes accordingly around the periphery, or constricts from the upper and lower axis points on the first axis of symmetry S1 to the lateral axis points on the second axis of symmetry S2, which is also the case in the running bore. This results from the fact that the two single bores 18, 19 each have a bore diameter d1, d2 which is slightly smaller than the diameter which a purely centric bore would have. Such a centric bore 25, as would be provided in the prior art, is shown in dotted lines in FIG. 6. Evidently, the diameter of such a centric bore would correspond to the length of the longer first axis of symmetry S1. Viewed in the direction of the shorter second axis of symmetry S2, the comparison in FIG. 6 clearly shows that the width B2 of the gap 24 is significantly smaller compared with the situation of the centric bore 25. As a result, as FIG. 6 furthermore clearly shows, the total cross-sectional area of the gap 24 is significantly smaller in the embodiment of a slot-like bore 15 compared with the cross-sectional area in the case of a centric bore 25, which in turn leads to the possibility of a significant reduction in leakage volume, and accordingly an improvement in the delivery volume and also the efficiency of the screw pump.

FIGS. 7 and 8 show, for comparison, the arrangement of the spindle 4 in a centric bore 25, i.e. a bore with constant diameter which corresponds to the length of the first axis of symmetry S1. Here too, the central axis ZS of the spindle 4 is off-axis relative to the central axis Z of the circular centric bore 25, i.e. here too there is an axial offset against the bending direction R.

If now the spindle 4 is loaded in operation, it bends slightly, as shown in FIG. 8. Evidently, the spindle 4 then lies quasi-centrally in the centric bore 25. There is an annular peripheral gap 24 which has approximately the same width B1 over the entire periphery, i.e. the gap width which is present only at the upper and lower axis points in the embodiment according to the invention. Evidently, the cross-sectional area of the annular gap 24 shown in FIG. 8 is significantly larger than the area of the gap 24 according to FIG. 6.

The reduction in gap area according to the invention, or the reduction in the distance of the bore inner wall from the spindle viewed in the plane of the shorter second axis of symmetry S2, results from the slot-like design and the fact that this offers the possibility of creating the respective bore from two single bores, the respective individual diameters d1, d2 of which are each smaller than the diameter d of a cylindrical bore which would be suitable for receiving the spindle bend in the same fashion. This means that d1, d2<d.

Although it is described above that the respective bore 15, 16 is formed from two single bores 18, 19 or 20, 21 which are made next to one another and intersect, in principle it is also possible to form the respective bore 15, 16 by means of a milling cutter, which firstly produces a bore and secondly however can also be moved slightly in the bending direction in order to create the slot geometry. This too has a diameter which is smaller than the diameter of the drill which would form a centric bore as is usual in the prior art.

Figure 9:
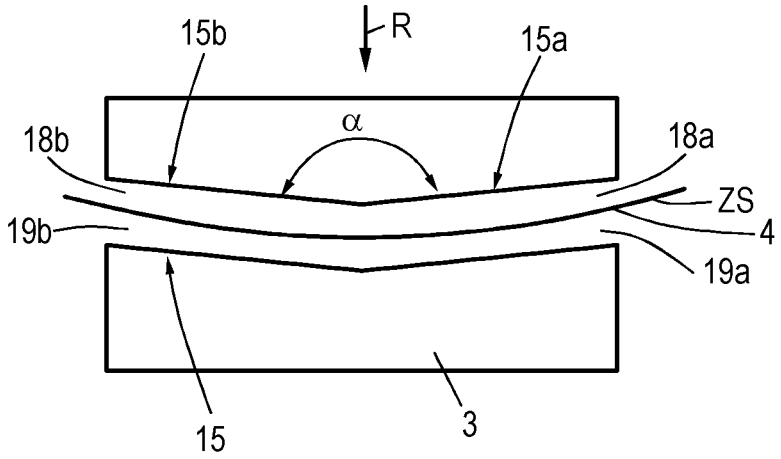

In the exemplary embodiment of the figures described above, each bore 15, 16 extends linearly through the housing 3. Alternatively, however, it is also possible to form the respective bore 15, 16 from two mutually adjoining bore portions, the central axes of which are angled slightly relative to one another in order, via this relatively angled design of the bore portions, to receive the form of the generated spindle bend. A general illustration of such an arrangement is shown in FIG. 9. This shows the example of the housing 3 and the bore 15. The latter consists of two bore portions 15*a*, 15*b*, wherein each bore portion in turn consists of two separate intersecting single bores 18*a*, 19*a* and 18*b*, 19*b*, which intersect as described above with respect to the first alternative of the invention. This means that here too, the single bores 18*a*, 19*a* or 18*b*, 19*b* are offset minimally by distance a in the bending direction. Evidently, the bore portions 15*a*, 15*b* are not aligned with one another but stand at an angle $\alpha \neq 180°$ to one another, i.e. are tilted or offset quasi-centrally in the bending direction R.

FIG. 9 furthermore shows diagrammatically the course of the central axis ZS of the spindle 4 which, because of the spindle bend, is necessarily also slightly bent. The angled position of the bore portions 15*a*, 15*b* approximately follows this course of the bending line or curved axis path, so that finally the resulting quasi-angled or kinked bore 15 is better adapted to the spindle geometry resulting from hydraulic loading.

Here too, naturally the bend and the angled position are shown significantly exaggerated for illustration purposes. In fact, the angle $\alpha$ amounts to only a few minutes.

Although the exemplary embodiments described, in particular in FIGS. 1-4, show a double-flow screw pump with two spindles, the invention is naturally not restricted thereto. Rather, it may also be a single-flow screw pump, wherein only one worm screw profile is provided on each spindle. In addition, more than two spindles may be provided, i.e. a central working spindle and two parallel running spindles may be provided. In principle, the slot-like design of the respective spindle bore according to the invention may be used wherever a spindle bend is created in operation because of the given hydraulic pressure conditions and must be compensated.

While specific embodiments of the invention have been shown and described in detail to illustrate the inventive principles, it will be understood that the invention may be embodied otherwise without departing from such principles.

We claim:

1. A screw pump, comprising a housing with a running bore having at least two intersecting bores, each of which receives a spindle, wherein the spindles have worm screw profiles which intermesh in portions and in operation bend in a defined bending direction under a hydraulic bending pressure, wherein each bore is configured as a slot with a longer first axis of symmetry and a shorter second axis of symmetry standing orthogonally thereto, wherein the longer first axis of symmetry runs in the bending direction.

2. The screw pump according to claim 1, wherein in an unloaded state, the spindles are arranged offset from the center of the first axis of symmetry.

3. The screw pump according to claim 2, wherein the spindles are positioned such that, for a defined pressure difference between a suction side and a pressure side of the pump or within a defined differential pressure range, the width of a gap between the worm screw profiles and a bore inner wall in the direction of the first axis of symmetry is greater than the width of the gap in the direction of the second axis of symmetry.

4. The screw pump according to claim 1, wherein each bore is formed from two separate intersecting single bores, the bore axes of which are offset from one another in the bending direction, or as a milled bore, or as a bore ground from a cylindrical bore.

5. The screw pump according to claim 1, wherein the at least two bores extend over the entire length of the housing.

6. The screw pump according to claim 1, wherein each bore consists of two bore portions adjoining one another axially, wherein the central axes of the bore portions are angled relative to one another.

7. The screw pump according to claim 1, wherein each spindle has two axially adjacent worm screw profiles with equal and opposite pitch, provided in the region of the longitudinal center of the respective spindles.

8. The screw pump according to claim 1, wherein the pump is a fluid pump or a multiphase pump.

9. A housing for a screw pump according to claim 1, with a running bore having at least two intersecting bores, each of which receives a spindle, wherein the spindles have worm screw profiles which intermesh in portions and in operation of the screw pump bend in a defined bending direction under a hydraulic bending pressure, wherein each bore is configured as a slot with a longer first axis of symmetry and a shorter second axis of symmetry standing orthogonally thereto, wherein the longer first axis of symmetry runs in the bending direction.

10. The housing according to claim 9, wherein each bore is formed from two separate intersecting single bores, the bore axes of which are offset from one another in the bending direction, or as a milled bore, or as a bore ground from a cylindrical bore.

11. The housing according to claim 9, wherein the at least two bores extend over the entire length of the housing.

12. The housing according to claim 9, wherein each bore consists of two bore portions adjoining one another axially, wherein the central axes of the bore portions are angled relative to one another.

13. A method for producing a housing for a screw pump according to claim 1, comprising a running bore formed from at least two intersecting bores, wherein to form each bore, either at least two separate intersecting single bores, the bore axes of which are offset from one another, are bored in a housing body, or each bore is milled with the two different axes of symmetry, or each bore is formed by grinding a cylindrical bore with the two different axes of symmetry.

14. The method according to claim 13, wherein the at least two bores extend over the entire length of the housing body.

15. The method according to claim 13, wherein each bore consists of two bore portions adjoining one another axially, wherein the central axes of the bore portions are angled relative to one another, wherein to form the bore portions, two separate single bores are bored on the two mutually opposite sides of the housing body.

* * * * *